US006112363A

United States Patent [19]

Chen

[11] Patent Number: 6,112,363

[45] Date of Patent: Sep. 5, 2000

[54] BATH BELT

[76] Inventor: Ching-Chen Chen, No. 552, Kuang Fu Rd., Pei Tou, Chang Hua Hsien, Taiwan

[21] Appl. No.: 09/323,681

[22] Filed: Jun. 2, 1999

[51] Int. Cl.[7] ..... A47K 7/02; A47K 7/04

[52] U.S. Cl. ..... 15/222; 15/209.1; 15/229.11

[58] Field of Search ..... 15/209.1, 229.11, 15/222

[56] References Cited

U.S. PATENT DOCUMENTS

| | | | |
|---|---|---|---|
| 2,601,771 | 7/1952 | Cameron | 15/229.11 |
| 5,727,277 | 3/1998 | Chien | 15/229.11 |
| 5,758,386 | 6/1998 | Chen | 15/229.11 |
| 5,850,662 | 12/1998 | Galvan-Garza | 15/222 |
| 5,893,823 | 4/1999 | Li | 15/222 |
| 5,947,564 | 9/1999 | Chen | 15/229.11 |

*Primary Examiner*—Randall E. Chin

*Attorney, Agent, or Firm*—Dougherty & Troxell

[57] ABSTRACT

A bath belt including: a main body having a first elastic mesh tube which is pushed and gathered so that a periphery of the first elastic mesh tube is axially successively crimped into a waved shape; a pair of first binders respectively disposed on two opposite sides of the main body; and several second binders spaced from each other and disposed on the first elastic mesh tube for binding the same. The portions of the first elastic mesh tube between the second binders are expanded to a series of ball-like bodies. The main body further includes at least one second elastic mesh tube positioned between one end of the first elastic mesh tube and one of the first binders. The second elastic mesh tube is wound into an annular shape. The second elastic mesh tube is passed through the hole of the first elastic mesh tube and partially extends outside of the first elastic mesh tube. The first binder is passed through the upper and lower ends of the second elastic mesh tube to bind the upper and lower ends of the second mesh tube together.

6 Claims, 5 Drawing Sheets

BATH BELT

BACKGROUND OF THE INVENTION

The present invention relates to a cleaning article, and more particularly to a bath belt with a certain length and elasticity for enhancing the comfort and cleaning effect when in use.

The prior bath belt by the inventor of this application can be produced with better efficiency. Also, when forming the ball-like bodies, no hard block will be formed so that the uncomfortable feeling will not take place when in use. However, the above bath belt can still be improved in length and contact feeling with the human skin, as well as cleaning effect.

SUMMARY OF THE INVENTION

It is therefore a primary object of the present invention to provide a bath belt the length of which can be easily elongated in manufacturing.

It is a further object of the present invention to provide the above bath belt which is able to achieve a better cleaning effect.

According to the above objects, the bath belt of the present invention includes: a main body formed by a first elastic mesh tube which is pushed and gathered so that a periphery of the first elastic mesh tube is axially successively crimped into a waved shape; a pair of first binders respectively binding two opposite ends of the main body; and several second binders spaced from each other by a predetermined distance and disposed on the first elastic mesh tube between the first binders for binding the first elastic mesh tube. The bath belt is characterized in that the main body further includes at least one second elastic mesh tube positioned between one end of the first elastic mesh tube and one of the first binders. The second elastic mesh tube is wound into an annular shape with a certain diameter and passed through the shaft hole of the first elastic mesh tube so as to partially extend outside the two ends of the first elastic mesh tube. One end of each first binder is passed through the shaft hole of the second elastic mesh tube extending from the upper and lower ends of the first mesh tube to bind the second mesh tube.

The present invention can be best understood through the following description and accompanying drawings wherein:

DETAILED DESCRIPTION OF THE PREFERRED EMBODIMENTS

Figure 1:
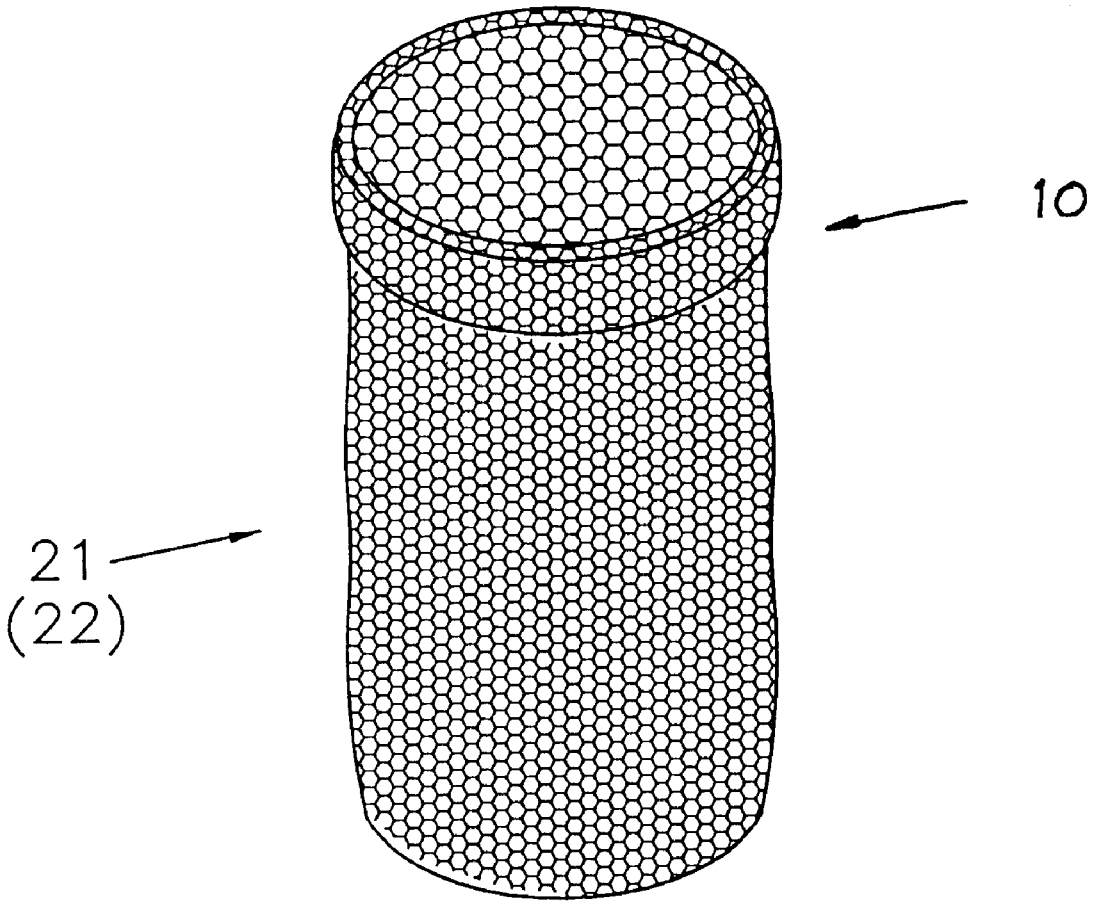
FIG. 1 is a perspective view of the first and second mesh tubes of a first embodiment of the present invention.
Figure 2:
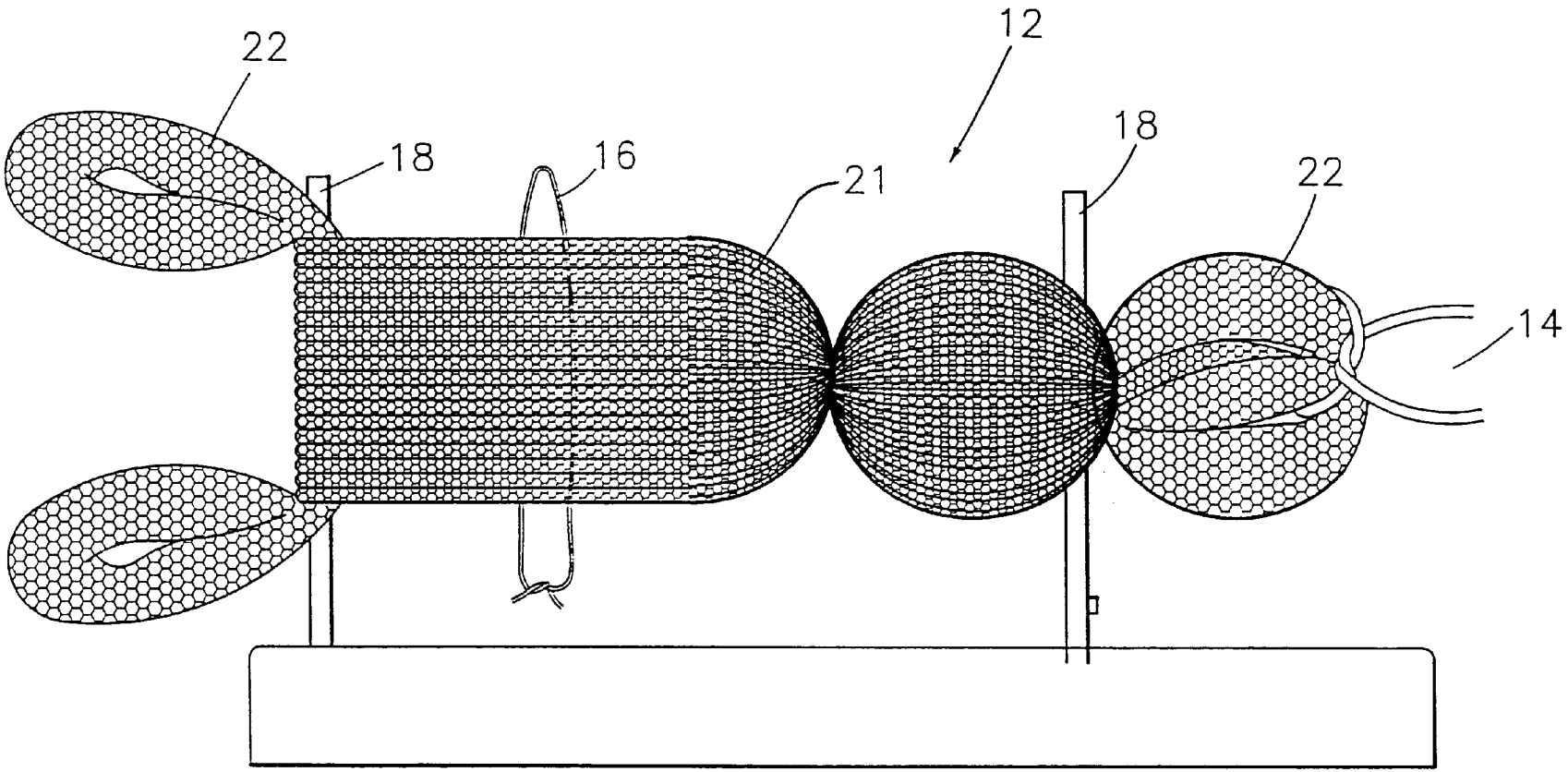
FIG. 2 shows the manufacturing procedure of the first embodiment of the present invention.
Figure 3:
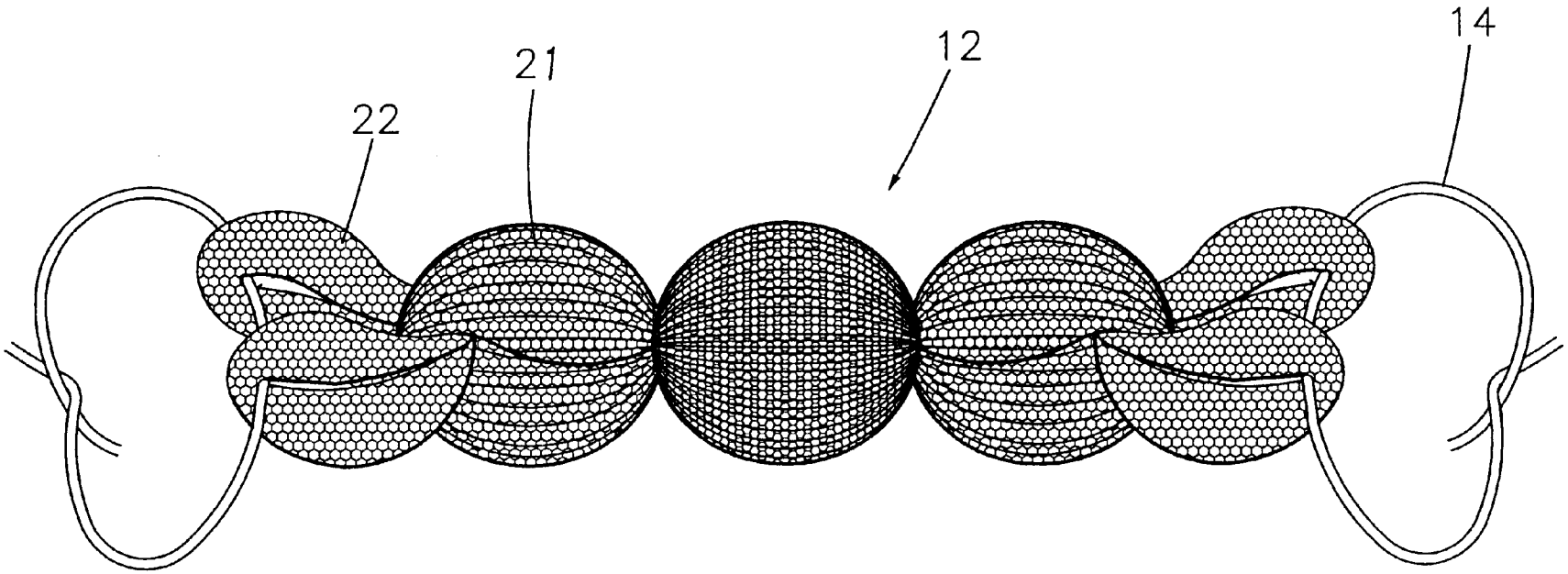
FIG. 3 is a perspective view of the first embodiment of the present invention.

Please refer to FIGS. 1 to 3. The bath belt 10 of the present invention includes a main body 12, a pair of first binders 14 fixed at two ends of the main body 12 and a plurality of second binders 16 fixed on the main body 12.

The main body 12 includes a first elastic mesh tube 21 and a pair of second elastic mesh tubes 22 which are made of plastic material by integral molding, having a certain length, size and elasticity.

When manufacturing the bath belt 10, the first elastic mesh tube 21 is first transversely extended and downwardly fitted onto two spaced apart rod members 18 which pass through holes in the mesh tube 21. Then the part of the mesh tube 21 extending between the two rod members 18 is successively downward pushed and gathered. Therefore, the periphery of the first elastic mesh tube 21 is gathered on the two rod members 18 to form a continuous crimped and waved pattern.

Then each second elastic mesh tube 22 is wound along its axis into an annular shape. Then each annular second elastic mesh tube 22 is passed through the hole of the first elastic mesh tube 21 near the rod member 18. The second mesh tubes 22 have the upper and lower ends exposed outside of the first elastic mesh tube 21 (as shown at the left end of the first mesh tube of FIG. 2).

Then the string-shaped first binder 14 is passed through the upper and lower ends of the second mesh tube 22 extending from the first mesh tube 21 to bind the upper and lower ends of the second mesh tube 22 with each other. Then two ends of the first binder 14 are tied together.

The number of the second binders 16 is not limited. The second binders 16 are spaced from each other by a certain distance and are wound around the first mesh tube 21. The plane of the second binder 16 is perpendicular to the axis of the first mesh tube 21. Then the first mesh tube 21 is bound by the second binders 16.

Finally, the first elastic mesh tube 21 is taken off of the rod members 18. By means of the elasticity of the first and second elastic mesh tubes 21, 22, the partitioned parts of the first mesh tube 21 between the respective second binders 16 and the second mesh tubes 22 are expanded into a ball pattern to form a bath belt 10 extending a certain length.

The bath belt 10 is advantageous in that by means of the second elastic mesh tubes 22, the length of the bath belt 10 is increased. A manufacturer can alternatively manufacture the bath belt with a first elastic mesh tube 21 having a larger diameter so as to increase the length of the bath belt. However, the existing machines for manufacturing integrally molded mesh tube cannot make a mesh tube with a super large diameter and it is very expensive to modify the machines. Therefore, according to the structure of the present invention, it is unnecessary to modify the machine and the length of the bath belt can be still elongated.

One of the advantages of the bath belt 10 in use resides in that the first and second elastic mesh tubes 21, 22 are wound and expanded to different extents so that they can brush human skin by two different ways and achieve a better cleaning effect.

Figure 4:
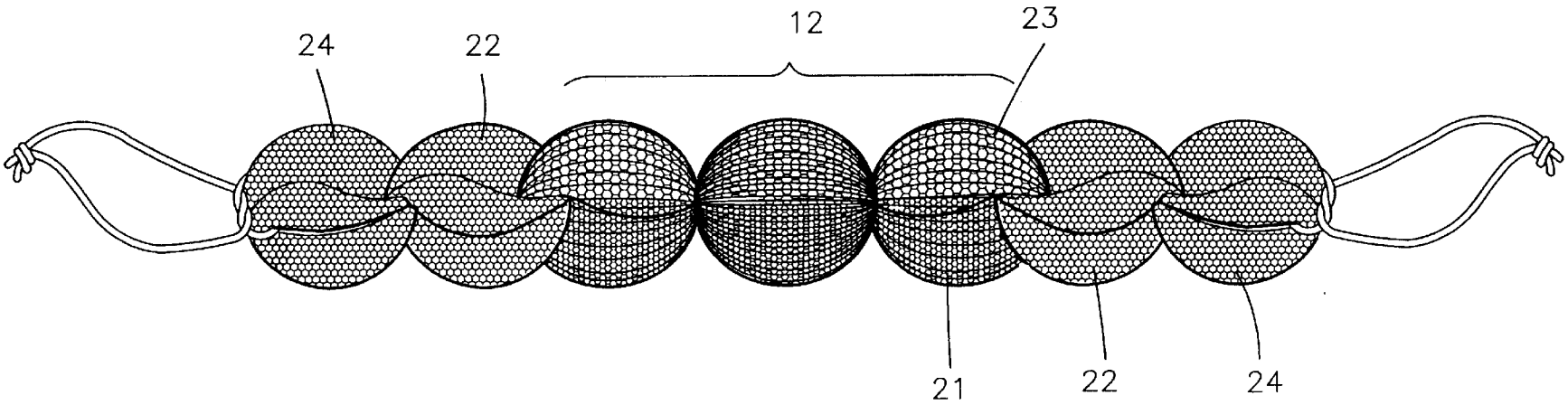
FIG. 4 is a perspective view of a second embodiment of the present invention.

FIG. 4 shows another embodiment of the present invention, in which a third elastic mesh tube 23 and a pair of fourth elastic mesh tubes 24 are added to the bath belt. In the manufacturing procedure of this bath belt, the third mesh tube 23 is also fitted onto the rod members 18 above the first mesh tube 21. Therefore, the middle section of the main body 12 includes two kinds of meshes with different colors. This makes the bath belt more beautiful and is also able to achieve an even better cleaning effect.

In addition, the fourth mesh tubes 24 are disposed between the second mesh tube 22 and the first binder 14. The fourth mesh tube 24 is passed through the second mesh tube 22 in the same manner in which the second mesh tube 22 is passed through the first mesh tube 21. Accordingly, the length of the bath belt 10 can be further increased. If the fourth mesh tube 24 is made of a material with different colors or mesh shapes, the bath belt 10 will have another washing aspect so as to achieve an even better cleaning effect.

A pair of fifth elastic mesh tubes (not shown) can be added to the bath belt of the present invention. The fifth mesh tubes together with the second or fourth mesh tubes 22, 24 form an annular structure so as to enhance the function of the bath belt 10.

Figure 5:
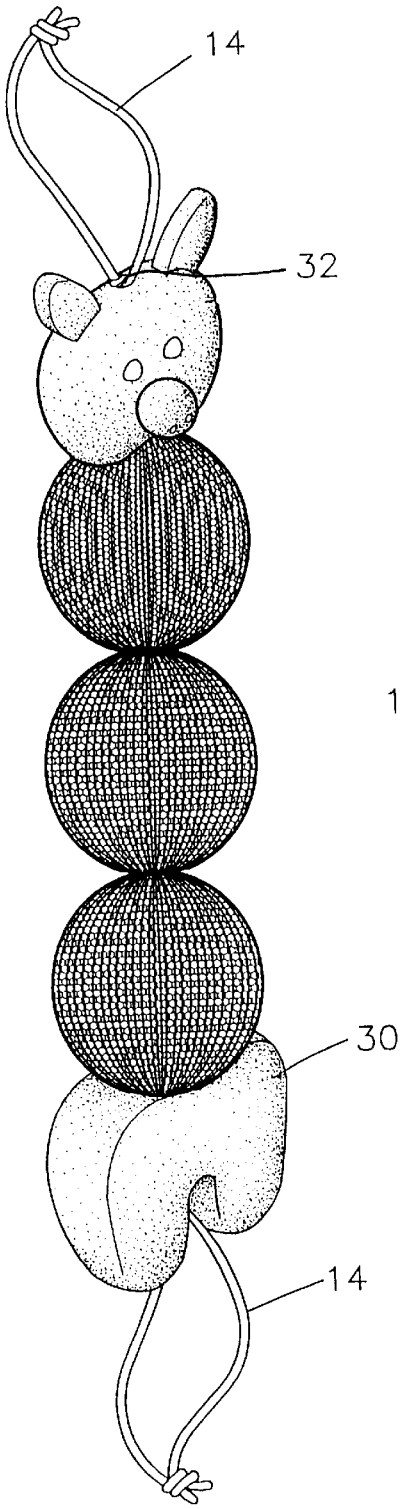
FIG. 5 is a perspective view of a third embodiment of the present invention.
Figure 6:
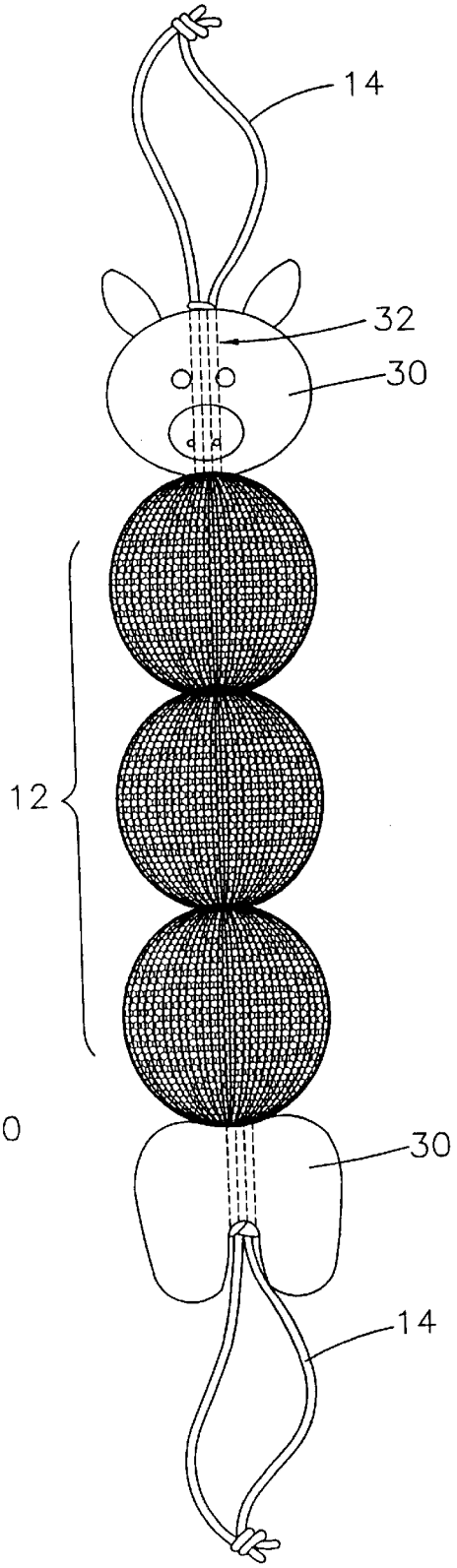
FIG. 6 is a front view of the third embodiment of the present invention.

FIGS. 5 and 6 show still another embodiment of the present invention, in which the two extension members 22 of the above embodiment are replaced by block-like second extension members 30 which can be made of water-absorbent materials such as sponge or plastic foam. Alternatively, the block-like second extension member 30 can be a sponge or fiber article coated by a cotton cloth or an unwoven fabric, such as a filling toy. The appearance of the block-like second extension member 30 can be designed as a lovely doll. The second block-like extension member 30 can be formed with one or a pair of through holes 32. A free end of the first binder 14 is conducted through the through hole 32 so as to fix the second block-like extension member 30 at each end of the main body 12. Accordingly, several advantages are achieved, such as the length of the main body 12 is increased, the fineness of the surface of the main body is varied, the entertaining effect is enhanced, etc. In addition, the connection portion between the second extension member 30 and the main body 12 will not form a hard section to affect the comfort of a user in use.

The above embodiments are only used to illustrate the present invention, not intended to limit the scope thereof. Many modifications of the above embodiments can be made without departing from the spirit of the present invention.

What is claimed is:

1. A bath belt comprising:

a main body including a first elastic mesh tube having a predetermined length and diameter;

a pair of first binders respectively disposed on two opposite sides of the main body for binding the same; and a plurality of spaced apart second binders disposed on the first elastic mesh tube between the first binders, the second binders being substantially perpendicular to an axis of the first elastic mesh tube, each second binder being wound around the first elastic mesh tube to bind the same, whereby portions of the first elastic mesh tube between the first binders are expanded into a series of ball-like bodies, wherein said main body further includes at least one second elastic mesh tube positioned between one end of the first elastic mesh tube and one of the first binders, the second elastic mesh tube having an annular shape and passing through a hole of the first elastic mesh tube such that first and second ends of the second elastic mesh tubes extend outside the first elastic mesh tube, the first binder passing through the first and second ends of the second elastic mesh tube extending from the first mesh tube to bind the first and second ends of the at least one second mesh tube together.

2. The bath belt as claimed in claim 1, wherein the main body further comprises two second elastic mesh tubes respectively, one second elastic mesh tube disposed at each opposite end of the first elastic mesh tube.

3. The bath belt as claimed in claim 1, wherein the main body further comprises a third elastic mesh tube coaxially disposed with the first elastic mesh tube, the peripheries of both the first and third elastic mesh tubes being successively crimped into waved shape.

4. The bath belt as claimed in claim 3, wherein the main body comprises a fourth elastic mesh tube positioned between the at least one second mesh tube and the first binder, the fourth mesh tube having an annular shape and passing through the first and second ends of the at least one second mesh tube so as to partially extend out of the first and second ends of the at least one second mesh tube, the first binder passing through the fourth elastic mesh tube so as to bind ends of the fourth mesh tube together.

5. The bath belt as claimed in claim 4, further comprising a fifth elastic mesh tube coaxially and serially connected with the at least one second mesh tube and together therewith having an annular shape and passing through the same end of the first elastic mesh tube.

6. The bath belt as claimed in claim 1, wherein the main body further comprises a third elastic mesh tube positioned between the at least one second mesh tube and the first binder, the third mesh tube having an annular shape and passing through the first and second ends of the second mesh tube so as to partially extend out of the first and second ends of the at least one second mesh tube, the first binder passing through the third elastic mesh tube so as to bind ends of the third mesh tube together.

* * * * *